US008720238B1

(12) United States Patent
Davis

(10) Patent No.: US 8,720,238 B1
(45) Date of Patent: May 13, 2014

(54) ELECTRONIC ACCESS CONTROL SYSTEMS

(71) Applicant: Videx, Inc., Corvallis, OR (US)

(72) Inventor: Paul R. Davis, Corvallis, OR (US)

(73) Assignee: Videx, Inc., Corvallis, OR (US)

( * ) Notice: Subject to any disclaimer, the term of this patent is extended or adjusted under 35 U.S.C. 154(b) by 0 days.

(21) Appl. No.: 13/728,417

(22) Filed: Dec. 27, 2012

Related U.S. Application Data

(60) Provisional application No. 61/719,943, filed on Oct. 29, 2012.

(51) Int. Cl.
*E05B 47/06* (2006.01)

(52) U.S. Cl.
USPC ..... 70/278.7; 70/416; 70/419; 70/491; 70/496

(58) Field of Classification Search
USPC ..... 70/491, 496, 416, 421, 278.2, 278.3, 70/278.7, 419
See application file for complete search history.

(56) References Cited

U.S. PATENT DOCUMENTS

| | | | | | |
|---|---|---|---|---|---|
| 2,690,070 | A * | 9/1954 | Spain | 70/421 |
| 3,485,068 | A * | 12/1969 | Bennett | 70/360 |
| 3,599,455 | A * | 8/1971 | Pilvet | 70/123 |
| 3,604,231 | A * | 9/1971 | Buschi | 70/496 |
| 3,733,863 | A * | 5/1973 | Toepfer | 70/496 |
| 4,012,931 | A * | 3/1977 | Harunari | 70/496 |
| 4,446,709 | A * | 5/1984 | Steinbach | 70/496 |
| 4,771,620 | A * | 9/1988 | Kleinhany | 70/277 |
| 4,961,328 | A * | 10/1990 | Mundhenke | 70/1.5 |
| 5,216,909 | A * | 6/1993 | Armoogam | 70/278.7 |
| 5,542,274 | A * | 8/1996 | Thordmark et al. | 70/495 |
| 5,791,181 | A * | 8/1998 | Sperber et al. | 70/383 |
| 5,839,307 | A * | 11/1998 | Field et al. | 70/283 |
| 6,474,122 | B2 * | 11/2002 | Davis | 70/278.3 |
| 6,604,394 | B2 * | 8/2003 | Davis | 70/278.3 |
| 6,615,625 | B2 * | 9/2003 | Davis | 70/278.3 |
| 6,895,792 | B2 * | 5/2005 | Davis | 70/278.3 |
| 7,076,976 | B1 * | 7/2006 | Goldman | 70/33 |
| 7,698,916 | B2 * | 4/2010 | Davis | 70/34 |
| 8,186,194 | B2 * | 5/2012 | Field et al. | 70/491 |
| 8,276,414 | B2 * | 10/2012 | Luo | 70/278.7 |
| 2006/0096344 | A1 * | 5/2006 | Lee | 70/491 |

* cited by examiner

*Primary Examiner* — Lloyd Gall
(74) *Attorney, Agent, or Firm* — Chernoff Vilhauer McClung & Stenzel, LLP

(57) ABSTRACT

New and improved electronic locks and electronic keys with enhanced anti-tamper capabilities integrated into the electronic locks, additional contact-based communications and recharging capabilities in the electronic keys, and capabilities for an electronic lock to change the authorizations and characteristics of an electronic key by provide an access profile to the electronic key when the key touches the lock.

9 Claims, 10 Drawing Sheets

ELECTRONIC ACCESS CONTROL SYSTEMS

CROSS-REFERENCE TO RELATED APPLICATIONS

This application claims the benefit of U.S. Provisional Application No. 61/719,743, filed Oct. 29, 2012.

BACKGROUND OF THE INVENTION

This disclosure relates generally to electronic access control systems, and, more particularly, to electro-mechanical locks, electro-mechanical keys, devices and systems therefor, and functionality and methods of use of such locks, keys, devices, and systems.

Reliable and secure electronic access control systems that incorporate electronic lock cylinders and electronic keys have been designed and manufactured. U.S. Pat. No. 6,474,122, filed Feb. 13, 2001, (hereinafter, "the '122 patent") describes such a system and is hereby incorporated by reference in its entirety into this disclosure. The '122 patent describes an electronic locking system manufactured and sold under the brand name CyberLock by Videx, Inc., in Corvallis, Oreg.

The electronic locking system described in the '122 patent comprises electronic lock cylinders for retrofitting conventional tumbler pin type or other common lock cylinders, such conventional lock cylinders sometimes referred to simply as "cores" or "cylinder cores." The electronic cylinders replace standard mechanical lock cylinders and are installed without wiring, easily converting existing lock hardware into a full-featured access control system. Videx, Inc. has designed over 280 different electro-mechanical lock cylinder configurations for various types of locks—for locking doors, cabinets, cash boxes, trucks, gates, narcotic boxes, safes, vending machines, cell tower sites, traffic control boxes, server cabinets, padlocks, and other locks having a cylinder core or similar type of replaceable or interchangeable core.

The electronic locking system is a key-centric access control system designed to address security, accountability, and key control requirements throughout a business or other organization. The system uses electronic, programmable keys, or smart or intelligent keys which may be programmed by software to incorporate access permissions for each key user. Keys may be programmed to work only during specific hours, and only for the locks each person is allowed to access. Because the intelligent keys restrict access and cannot be duplicated, the need to re-key a facility is eliminated. If a key is lost or stolen, pre-programmed keys with authorizations set to expire may simply be left to expire, posing no risk exposure thereafter. If the lost key has an unacceptably long or no expiration time frame, the locks may be reprogrammed so that the lost key is no longer recognized.

The electronic locking system may be used to monitor key usage and track lock entry activity. Each time a key is used, a record of that event is stored in both the lock and the key. Access granted and access denied events are both recorded. Key management software may be used to assign keys, set expirations, add new cylinders, monitor staff and contractors, create access schedules, generate audit trails and custom reports, and so on.

As with any access control system, numerous aspects and features in the keys, particularly engineered lock cylinders, installation/application specific software, or other parts of the particular system may require configuration for the particular needs of the application. Various options for increased security features such as tamper resistance and key retention may be needed, for example. A particular application may require, for example, keys that are programmable using only certain types of communicators. Or a particular application may require lock cylinders with more or less sensitivity in the design of various tamper resistance features to address the environment within which the cylinders are installed. The increased number of options in key and lock designs, however, increases system complexity and costs. Further, new security features are needed to address increasingly complex customer requirements and to address new demands of the locks, keys, software, and other system components not previously contemplated or experienced.

What is needed, therefore, are improved electronic access control systems that incorporate security features that address customer and application-specific requirements.

BRIEF DESCRIPTION OF THE SEVERAL DRAWINGS

For a more complete understanding of the present invention, the drawings herein illustrate examples of the invention. The drawings, however, do not limit the scope of the invention. Similar references in the drawings indicate similar elements.

DETAILED DESCRIPTION OF PREFERRED EMBODIMENTS

In the following detailed description, numerous specific details are set forth in order to provide a thorough understanding of the preferred embodiments. However, those skilled in the art will understand that the present invention may be practiced without these specific details, that the present invention is not limited to the depicted embodiments, and that the present invention may be practiced in a variety of alternate embodiments. In other instances, well known methods, procedures, components, and systems have not been described in detail.

Figure 8A:
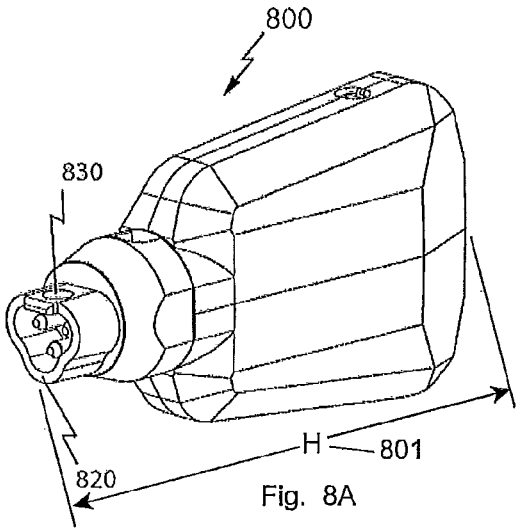
FIG. 8A is a perspective view of an exemplary electronic key, according to various embodiments, for use with an electronic lock cylinder such as the lock cylinder shown in FIG. 1A.

Although the preferred embodiments may be implemented in a wide variety of configurations involving different types of electronic keys, lock cylinders, or software, collectively referred to as components comprising an electronic access control system, the following detailed description discloses the preferred embodiments principally in the context of an exemplary lock cylinder 100, as illustrated in FIG. 1, and an exemplary key 800, as illustrated in FIG. 8A.

Figure 1A:
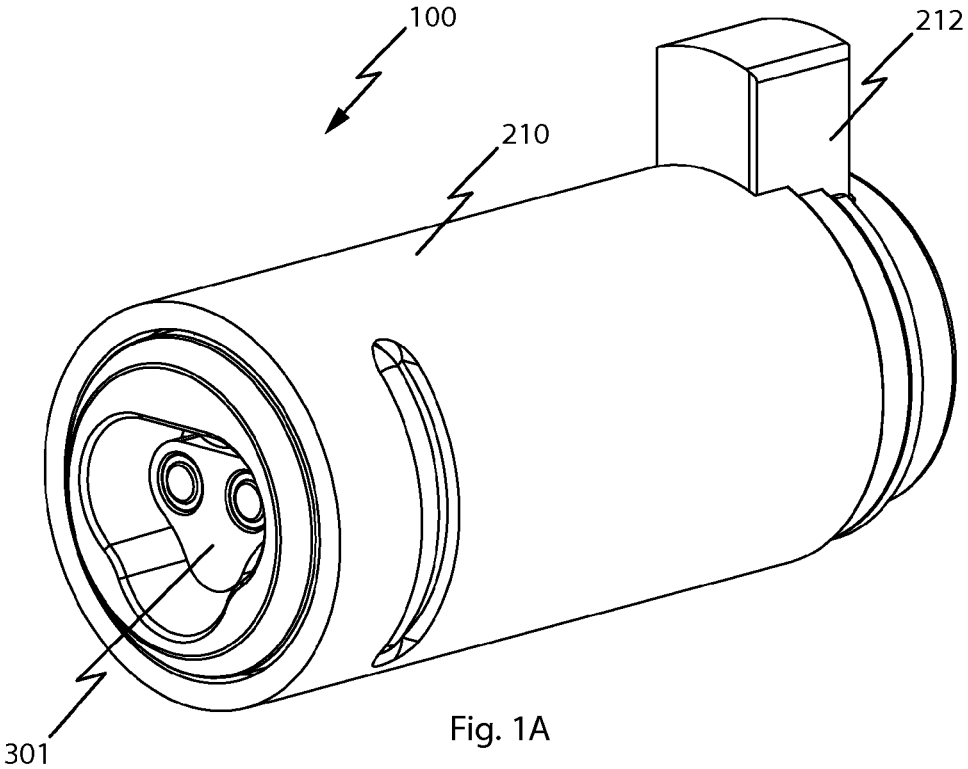
FIG. 1A is a perspective view of an exemplary electronic lock cylinder, according to various embodiments.

The electronic lock cylinder may be any of a wide variety of electronic lock cylinders manufactured to the dimensional standards of the mechanical lock it replaces. FIG. 1A is a perspective view of an exemplary electronic lock cylinder 100, according to various embodiments. The particular electronic lock cylinder 100 illustrated in FIG. 1A is CyberLock part number CLT-T6H, manufactured by Videx, Inc. to replace a mechanical cylinder having corresponding cylindrical length and width dimensions and having corresponding bolt/latch dimensions and mechanical range of bolt/latch motion. The CLT-T6H cylinder is designed to mount in the rear hole of a standard T-handle latch, typically the T-handle latch of a vending machine. The CLT-T6H has a unique dual action that allows it to operate both as a deadbolt and as a self-closing latch. Like a spring-latch, the bolt will automatically lock by pushing the T-handle towards the machine. Once locked, it returns to the more secure deadbolt mode.

Figure 1B:
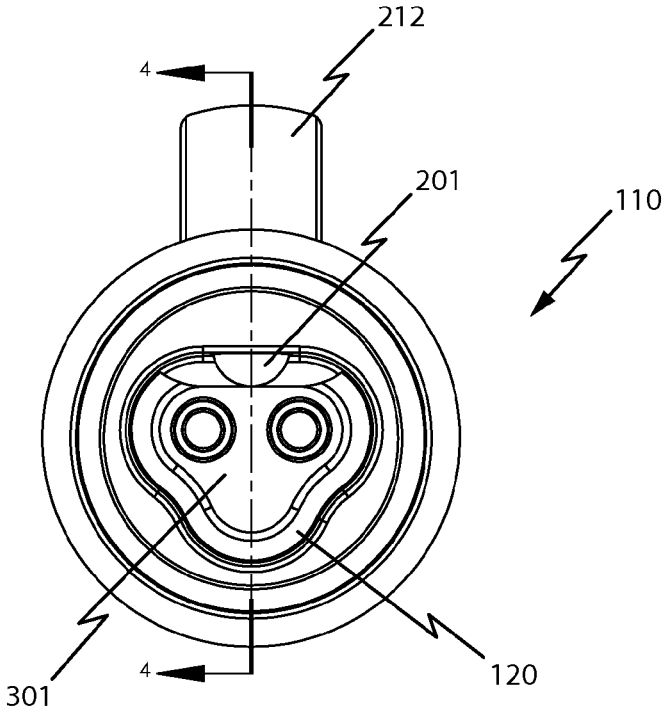
FIG. 1B is a front view is the lock cylinder of FIG. 1A.

FIG. 1B is a front view is the lock cylinder 100 of FIG. 1A. The nose 301, ball bearing 201, and key tip channel 120 that surrounds the nose 301, are portions of the lock cylinder core that, when in an unlocked state, rotate within the cylinder shell 210 along an axis running longitudinally from the front of the cylinder at nose 301 to the rear of the cylinder at latch/deadbolt 212. Rotation of the cylinder core allows for movement of the latch/deadbolt 212 in a direction perpendicular to the axis of rotation, with retraction of the latch/deadbolt 212 inward toward the axis of rotation providing an unlocked position of the cylinder 100.

Figure 2:
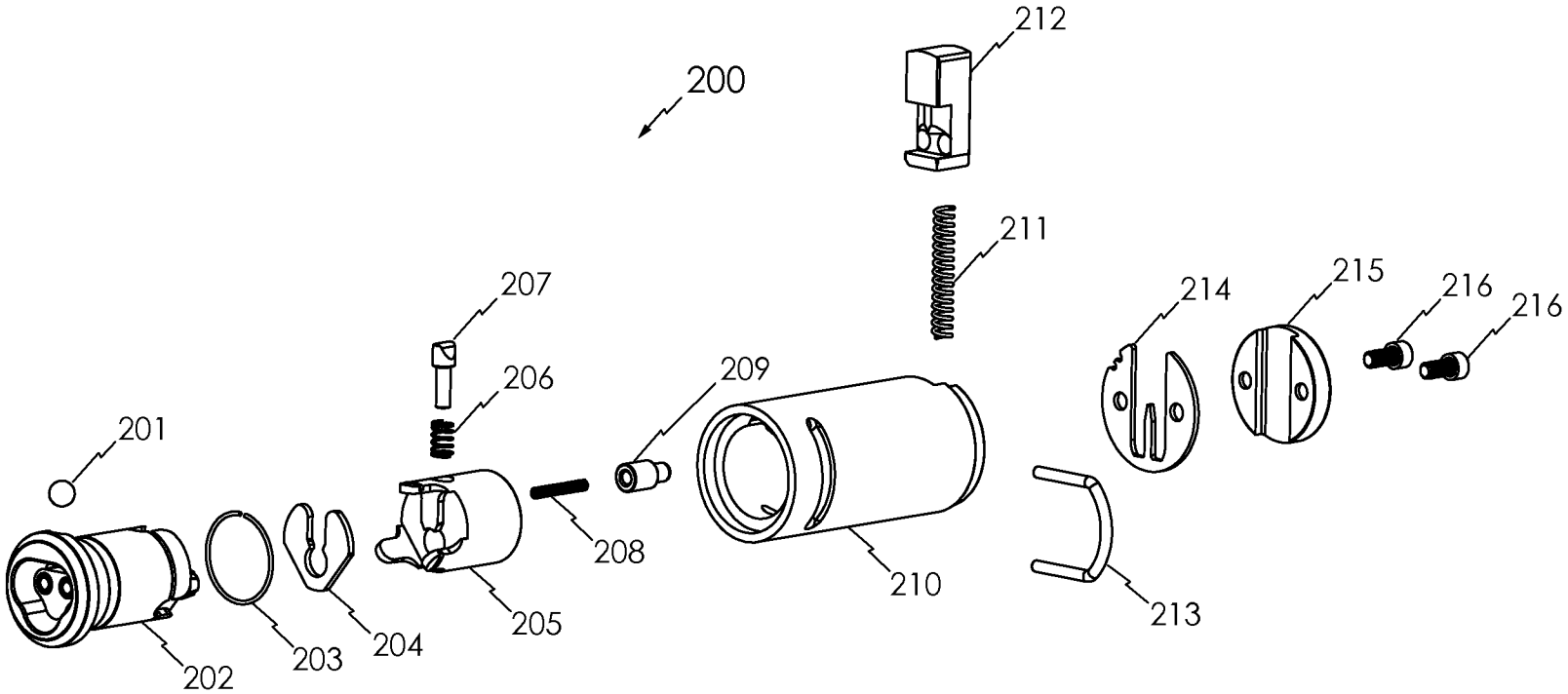
FIG. 2 is an exploded view of the lock cylinder of FIGS. 1A and 1B.

FIG. 2 is an exploded view of the lock cylinder 100 of FIGS. 1A and 1B. A front core electronics module 202 is mated to a back core 205 with a plate 204 between the two and held together with a snap ring 203. A ball bearing 201 is placed so as to extend downward in the channel 120 between the nose 301 and outward perimeter of the channel 120, the ball bearing 201 providing a key Lip retention feature when the core is rotated relative to the shell 210. A lock pin 207 and lock pin spring 206 are loaded into the back core 205, and the front and back core is loaded into the front end of the shell 210, with a retainer wire 213 used to hold the front core in a predetermined position within the shell 210. A latch/deadbolt driver pin 209 and driver pin spring 208 are loaded to the rear of the back core 205, and an alignment plate 214 is used to orient a latch/deadbolt compression spring 211 and latch/deadbolt 212. Finally, a back core cap 215 is fastened to the rear end of the back core with two retaining screws 216.

Figure 3:
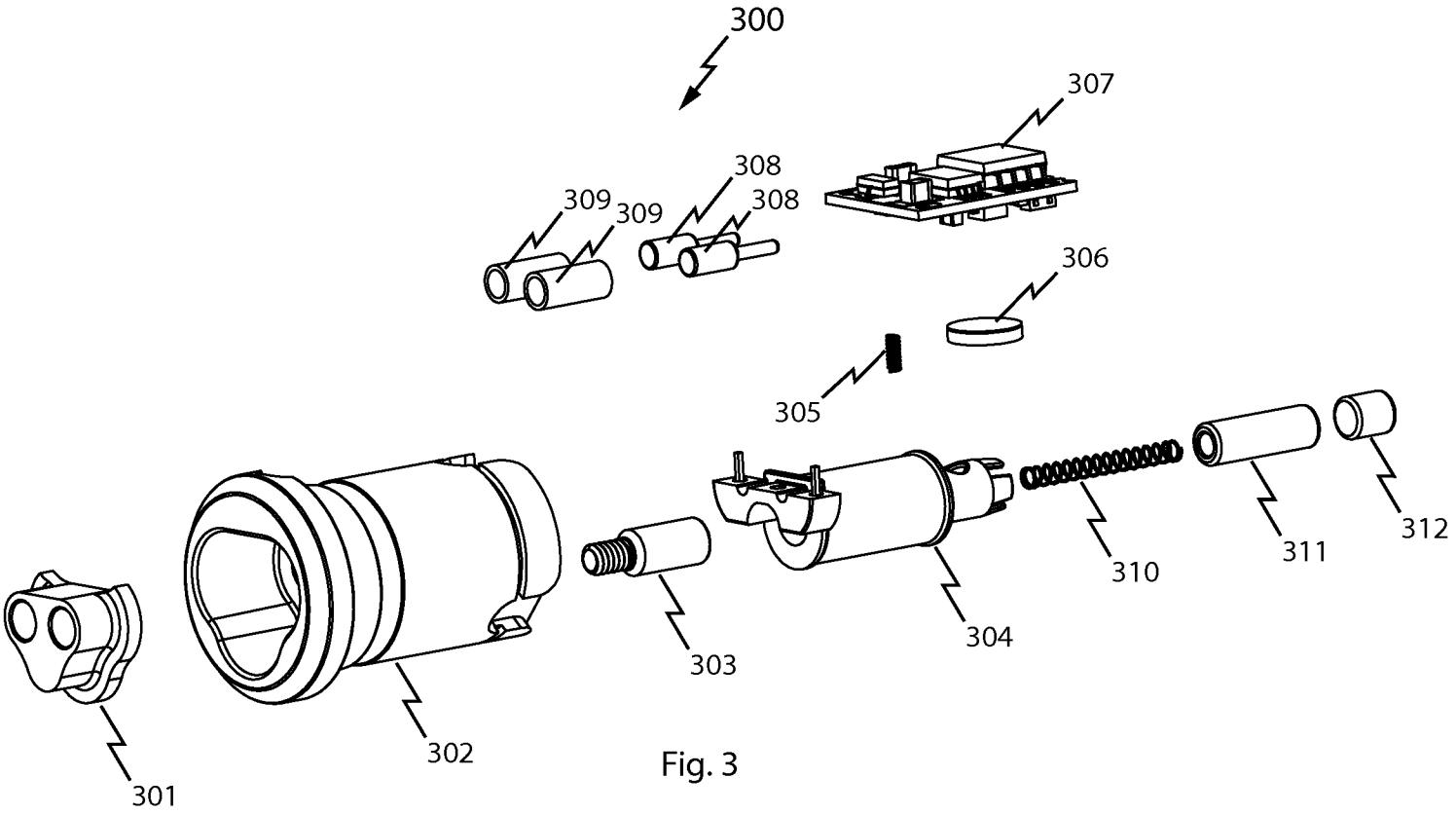
FIG. 3 is an exploded view of the front core portion of the lock cylinder of FIG. 2.
Figure 8B:
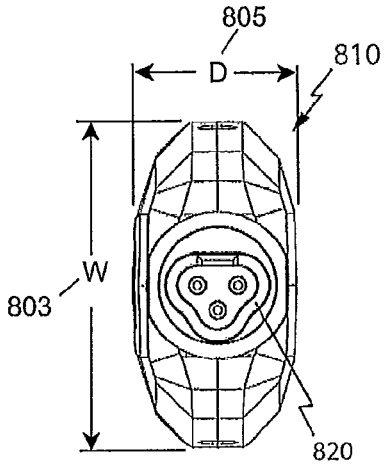
FIG. 8B is a front view of the electronic key of FIG. 8A.
Figure 9:
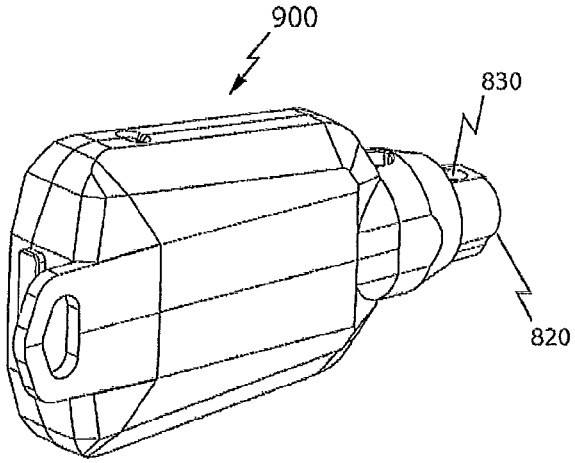
FIG. 9 is a rearward perspective view of the electronic key of FIG. 8A.

FIG. 3 is an exploded view of the front core 202 portion of the lock cylinder of FIG. 2. The triangularly shaped nose 301 fits within a correspondingly shaped front end of the electronics module case 302, with the space between the two forming a channel 120 within which the tip 820 of an electronic key 800, 810 (as shown in FIGS. 8A, 8B, and 9) is inserted for rotation of the cylinder core with respect to the shell 210 and latch/deadbolt 212. A solenoid pole 303 threadably attaches into the rear of the nose 301, and pins 308 and insulators 309 are inserted into the nose 301. A solenoid assembly 304 with spacer pad 306 and ground spring 305 is mated with circuit board 307 and inserted into the electronics module case 302. A solenoid spring 310 is fit within a solenoid plunger 311 and inserted into the solenoid assembly and in-line with the solenoid pole 303, the solenoid plunger 311 being oriented longitudinally between the nose 301 and back core cap 215, substantially parallel with the axis of rotation of the cylinder core within the shell 210. Finally, an anti-tamper plug, as used in the particular cylinder design, is positioned in-line with and to the rear of the solenoid plunger 311.

Figure 4:
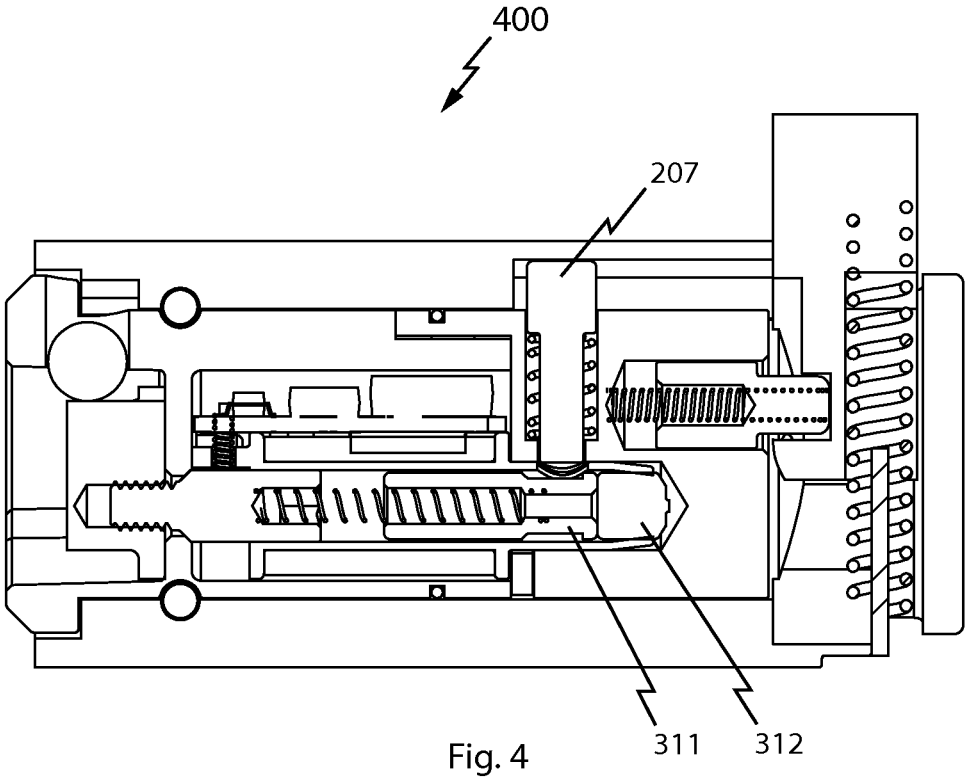
FIG. 4 is a cut view of the lock cylinder taken along the line 4-4 as shown in FIG. 1B, according to various embodiments, showing the solenoid plunger in a locking pin blocking position and a locking pin in a cylinder rotation interfering position.

FIG. 4 is a cut view of the lock cylinder 100, 110, 400 taken along the line 4-4 as shown in FIG. 1B, according to various embodiments, showing the solenoid plunger 311 in a locking pin 207 blocking position and a locking pin 207 in a cylinder rotation interfering position—as are the orientations when the cylinder core is not rotated with respect to the shell 210, and when the solenoid is not energized/actuated. When the cylinder core is in a home position, or in an at rest position, free from rotational forces applied to the cylinder core with respect to the shell 210, the top of the locking pin 207, which extends radially outward with respect to the axis of rotation of the cylinder core, extends into a cavity in the shell 210 to prevent rotation of the cylinder core with respect to the shell 210. When the solenoid is not energized/actuated, the solenoid spring 310 keeps the solenoid plunger 311 in a rearward position, extending rearward toward the back core cap 215 and thereby blocking downward (or radially inward) movement of the lock pin 207.

Figure 5:
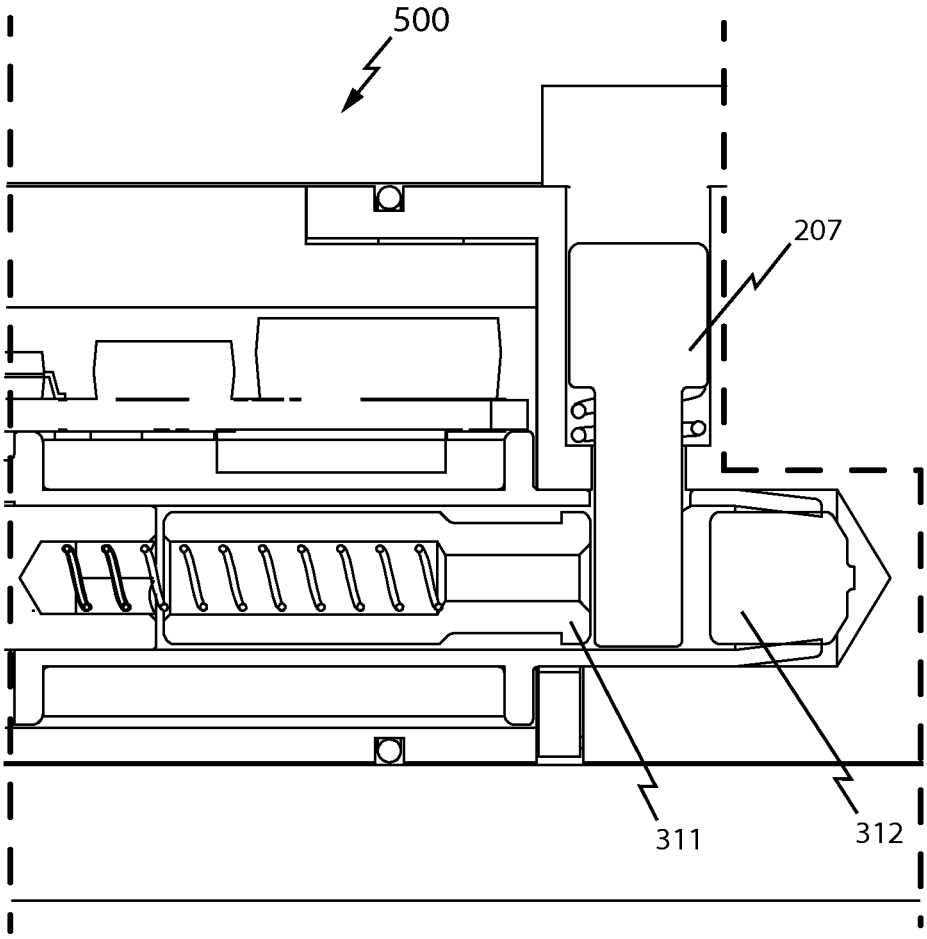
FIG. 5 is a central portion of the cut view FIG. 4, according to various embodiments, showing the solenoid plunger moved away from a locking pin blocking position and a locking pin moved away from a cylinder rotation interfering position.

FIG. 5 is a central portion of the cut view FIG. 4, according to various embodiments, showing the solenoid plunger 311 moved away from a locking pin 207 blocking position and a locking pin 207 moved away from a cylinder rotation interfering position—as are the orientations when the solenoid is energized/actuated, followed by rotation of the cylinder core with respect to the shell 210. When the solenoid is actuated, the solenoid plunger 311 is pulled forward toward the nose 301 of the cylinder core. With the solenoid plunger 311 moved to the solenoid's energized/actuated state, the cylinder core may be rotated with respect to the shell 210 so as to depress the lock pin 207, compressing the lock pin spring 206, causing the lower end of the lock pin 207 to extend into the space formerly occupied by the rear portion of the solenoid plunger 311.

Figure 6:
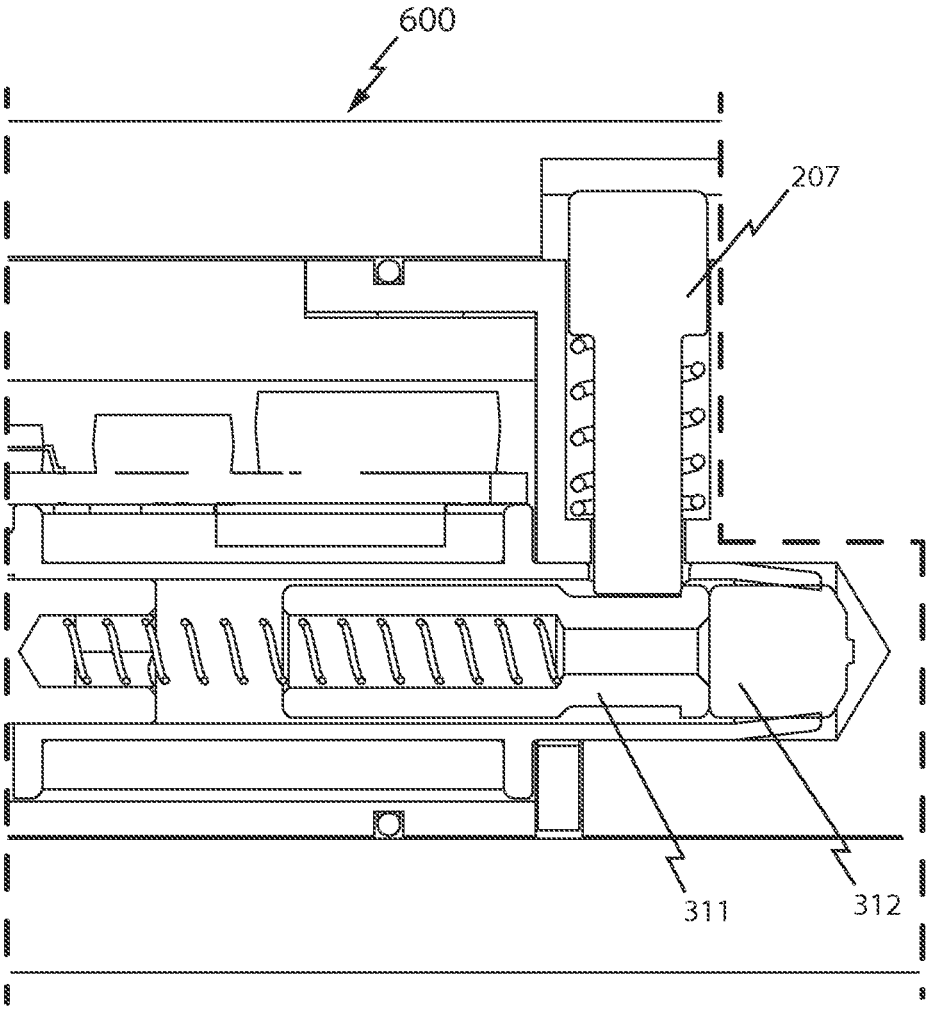
FIG. 6 is a central portion of the cut view FIG. 4, according to various embodiments, showing the solenoid plunger in a locking pin blocking position and a locking pin moved so as to contact the solenoid plunger.

FIG. 6 is a central portion of the cut view FIG. 4, according to various embodiments, showing the solenoid plunger 311 in a locking pin 207 blocking position and a locking pin 207 moved so as to contact the solenoid plunger 311—as are the orientations when the solenoid is not energized/actuated but the cylinder core is rotated with respect to the shell 210. As in FIG. 4, when the solenoid is not energized/actuated, the solenoid spring 310 keeps the solenoid plunger 311 in a rearward position, extending rearward toward the back core cap 215 and thereby blocking downward (or radially inward) movement of the lock pin 207. However, unlike FIG. 4, FIG. 6 shows the lock pin 207 moved downward (or radially inward) as would result if the cylinder core is rotated with respect to the shell 210. The lock pin 207 moved downward until contacting the solenoid plunger 310 as shown. The lock pin 207 is unable to move downward enough for the outward/upper end of the lock pin 207 to clear the radially outward portion of the shell 210. Consequently, the cylinder lock remains in a locked state, with the lock pin 207 preventing sufficient rotation of the cylinder core with respect to the shell 210 to provide movement of the latch/deadbolt 212.

Figure 7:
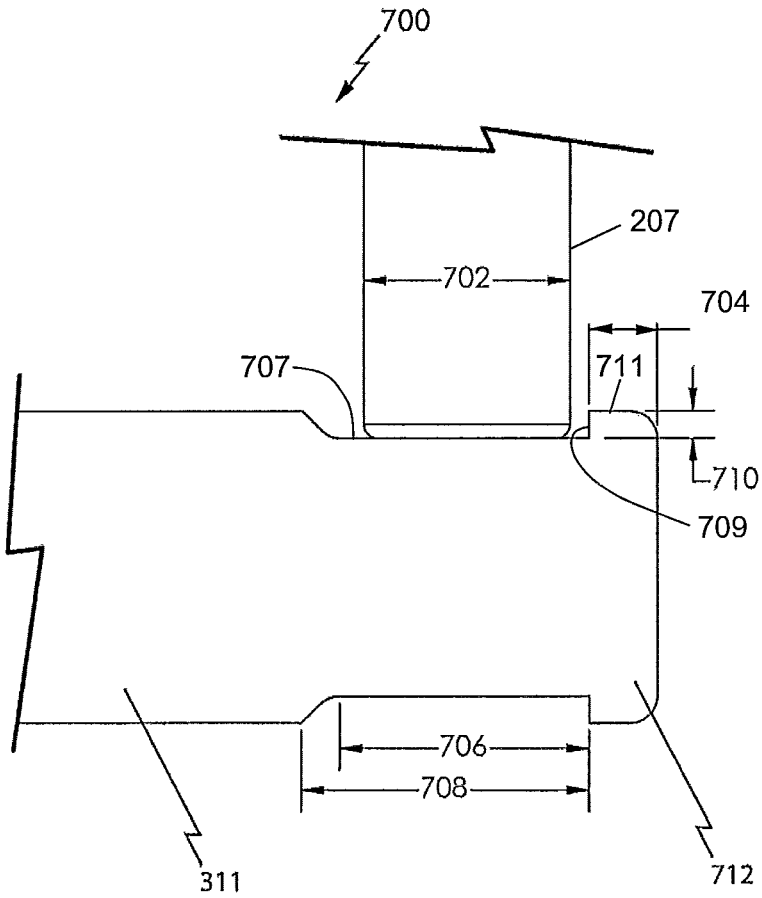
FIG. 7 is a detail sectional view, according to various embodiments, of a portion of the cut view FIG. 6.

FIG. 7 is a detail sectional view, according to various embodiments, of a portion of the cut view FIG. 6. The present inventors discovered that shaping the plunger 311 so as to include at its rearward end 712, aft of the region of contact 706 between the plunger 311 and the downward most end of the lock pin 207, an increased diameter or increased height 710 defining an increased diameter or height surface 711 connected by a surface 709 to a decreased diameter or height surface 707 of the adjoining region of contact 706, the increased height 710 being in the direction of the lock pin 207 orientation and travel, the lock pin 207 must travel up hill (i.e. radially outward toward the shell 210) to clear the rearmost end 712 of the plunger 311 in order for the plunger 311 to be moved forward, away from a lock pin 207 blocking position. If the lock pin 207 is in contact with the plunger 311 as shown, attempts to move the plunger 207 in a forward direction toward the nose 301 of the cylinder will be countered/challenged by requiring the lower end of the lock pin 207 that is in contact with the plunger 311 to have to ride up and over the increased height 710 (or increased diameter) portion of the rearmost end 712 of the plunger (the rearmost end of the plunger 311 having to be cleared in order for the lock pin 207 to be able to move downward enough to allow further rotation of the cylinder core with respect to the shell 210).

Exemplary dimensions for the lock pin 207 and solenoid plunger 311 shown in FIG. 7 include: a lock pin 207 diameter 702 of about 0.76", an unenergized-solenoid lock pin-to-solenoid plunger contact region 706 of about 0.96", a solenoid plunger rearmost end height increase 710 of about 0.010", a width 704 of the increased-height region of the rearmost end of the plunger of about 0.20", and a contact region-plus-lead in chamfer width 708 of about 0.106". Other dimensions may be used and still obtain the desired result of requiring the lock pin 207 to ride up and over a height increase as the plunger is moved in a forward (i.e. left) direction. For example, the height increase 710 is preferably carried through the width 704 of the rearmost end 712 of the plunger 311 as shown, but may be triangular/pointed with an initial (full) increase 710 where the lock pin 207 first contacts the increased height region 704 as the plunger 311 moves forward/left and tapering downward to the height/diameter in the contact region 706. That is, in other embodiments, the increased height region 704 may have the appearance of a right triangle, with its peak where the lock pin 207 initially contacts the increased height region 704, then tapering downward toward the rearmost end of the plunger 311. Less preferred embodiments may incorporate the opposite—having the increased height region 704 comprising a region of increasing height, ramping up from the contact region 706 to an increased height 710 at a rearward position within the increased height region 704. Or, in still other embodiments, the height increase 710 may be more rounded across the region 704 than shown. Or, as another example, in various embodiments, the edge of the lowermost end of the lock pin 207 may comprise a different radius so as to provide a different resistance to forward (i.e. left) movement of the plunger 311, and the corresponding radius of the transition from the contact region 706 to the increased height 710 may be different to further adjust resistance to forward movement of the plunger 311 when the lock pin 207 is in contact with the plunger or moved downward from its position shown in FIG. 4.

The present inventor discovered that tampering attempts whereby rotational forces are applied to the cylinder core along with attempts to get the solenoid plunger to move forward toward the cylinder nose, and, thereby into a non-lock pin blocking orientation, are substantially frustrated by incorporating a region of increased height over which the lock pin must pass in order for the lock pin to clear the rearmost end of the plunger. Sharp longitudinal forces applied to the nose end of the cylinder core may cause longitudinal movement of the plunger as well as longitudinal movement of the anti-tamper plug 312. When the anti-tamper plug 312 moves forward (i.e. left), it preferably moves into a lock pin blocking orientation preventing the lock pin 207 from moving downward. With plunger 311, anti-tamper plug 312, and other components formed and configured/arranged as shown in FIGS. 4-7, the present inventor determined tampering attempts are substantially challenged. The anti-tamper plug 312 is further described in U.S. Pat. No. 6,474,122, filed Feb. 13, 2001, (i.e. the '122 patent) which is incorporated by reference herein.

The aforementioned increased diameter/increased height (or uphill) region is a separable aspect that may be used in other applications beyond electronic lock cylinders, such as those that use one or more solenoid and solenoid plunger wherein the plunger provides a blocking function to block another member such as a lock pin. The increased height (or uphill) shaped lock pin blocking member may be used for anti-tampering in other applications where the lock pin blocking member is designed, in normal/typical operation, to move away from its blocking position/orientation before starting movement of the lock pin away from the lock pin's locked orientation.

FIG. 8A is a perspective view of an exemplary electronic key 800, according to various embodiments, for use with an electronic lock cylinder such as the lock cylinder shown in FIG. 1A. The aforementioned incorporated '122 patent describes operation and interaction of an electronic key and electronic lock cylinder similar to the locks and keys described herein. The key 800 includes, among other features, a tip end 820 that correspondingly mates with the lock cylinder channel 120 shown in FIG. 1B, and a depression 830 for receiving the ball bearing 201 shown in FIGS. 1B and 2.

Figure 10:
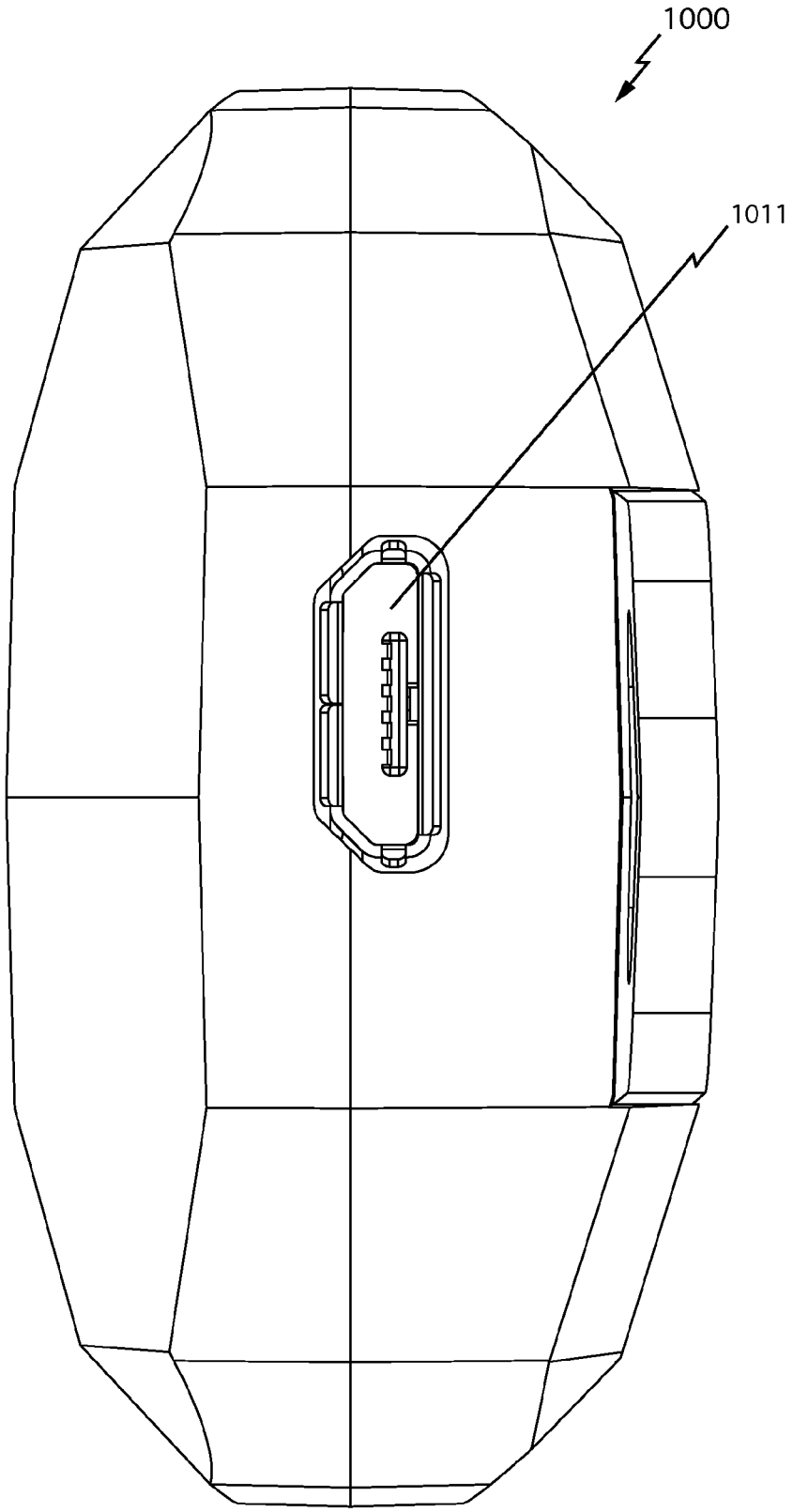
FIG. 10 is an end view of the electronic key of FIG. 8A.

FIG. 8B is a front view 810 of the electronic key 800 of FIG. 8A. The front view 810 illustrates the key tip end 820 which surrounds contact pins 1103 (described further in FIG. 11). FIG. 9 is a rearward perspective view 900 of the electronic key of FIG. 8A. FIG. 10 is an end view 1000 of the electronic key of FIG. 8A, and shows a relative position, in preferred embodiments, of a micro-USB receptacle 1011.

Figure 11:
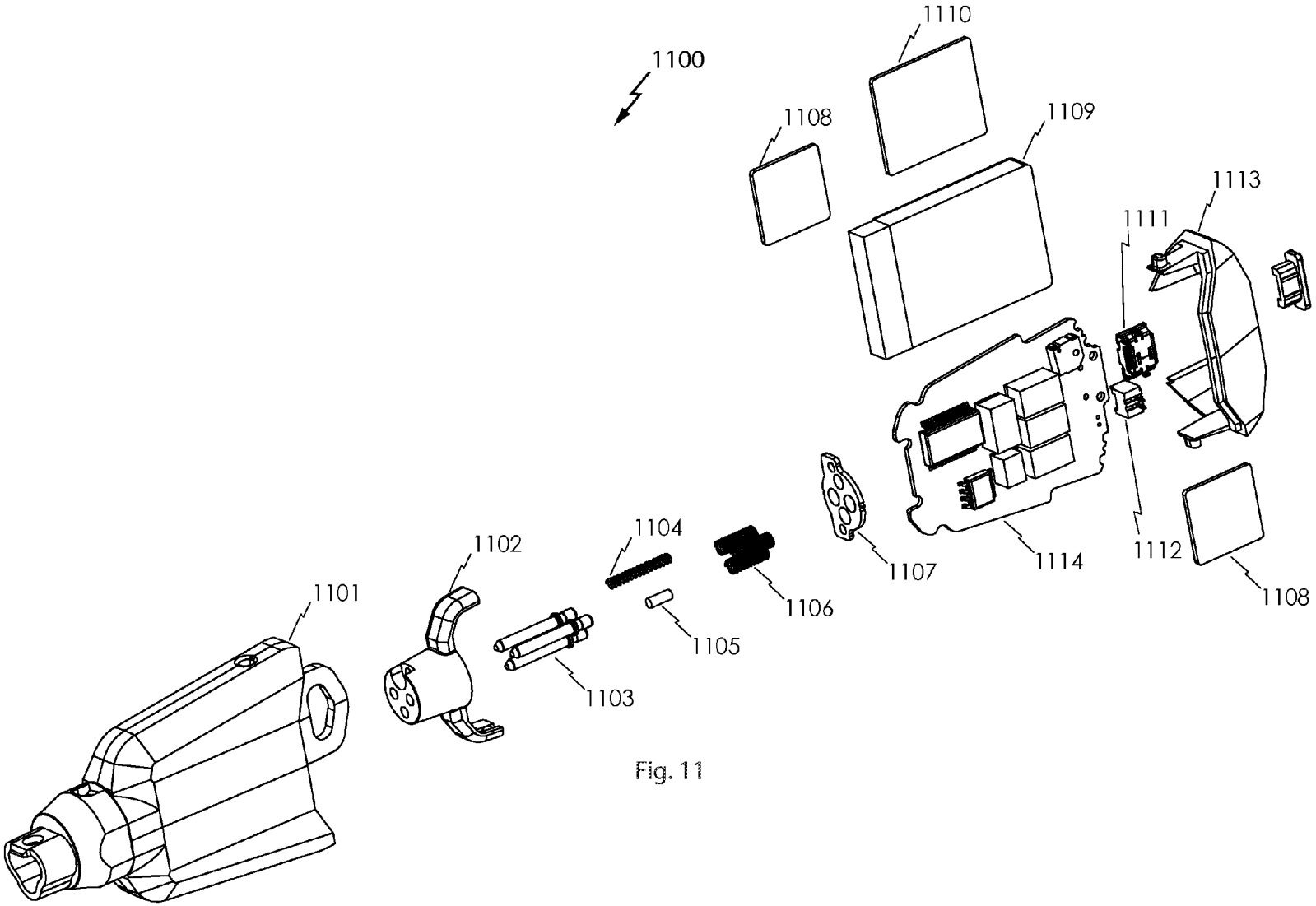
FIG. 11 is an exploded view, according to various embodiments, of the electronic key of FIG. 8A.

FIG. 11 is an exploded view 1100, according to various embodiments, of the electronic key of FIG. 8A. As illustrated, three contact pins 1103 are inserted into a holder 1102 which is then fit within a case assembly 1101. Each of the contact pins 1103 are movably connected to a PCB pin board 1107 via contact pin springs 1106. A ground spring 1104 and silicon cord 1105 are also shown. Top and bottom battery pads, 1108 and 1110, respectively, are used with rechargeable battery 1109. The main PCB assembly 1114 is electrically connected to the PCB pin board 1107 and battery 1109, and preferably includes a beeper (to provide audible feedback for key activity and success/fail/error indication), CPU (microprocessor), flash memory, capacitors, resistors, and various other associated circuitry, as well as a connector 1112 and micro-USB connector 1111, as shown. Although not shown, an LED, such as a green high-brightness LED, is preferably included as a visual indicator for key activity and success/fail/error indication. Finally, an end cap 1113 is used to enclose the rearmost end of the key assembly.

In preferred embodiments, the case assembly 1101 comprises a plastic body with faceted edges and sides, which the present inventor discovered advantageously provides a visual effect of the key assembly having a smaller size (in thickness, width, and length) than achieved using non-faceted (i.e. smooth, rounded features) surfaces comprising the body. A metallic key tip end (not numbered) is preferably used at the front or nose or key tip end of the body assembly 1101. The present inventor found that using a metallic key tip end offers improved resilience and durability, and provides improved key tip 820 surfaces which are used for torque delivery when the key is operated with a lock cylinder. In preferred embodiments, the outside surfaces of the key tip 820 are used to deliver torque for rotating a lock cylinder such as the lock cylinder 100, with the outer surfaces of key tip 820 applying torque to the radially outward surfaces of the key tip channel 120.

In at least one preferred embodiment, the case assembly 1101 comprises fiberglass reinforced nylon with a brass key tip 820; the key 800 dimensions are 2.72" H (801)×1.37" W (803)×0.69" D (805); the key 800 weight is 1.1 oz; the operating temperature range is 32 to 122 degrees F., zero to 50 degrees C.; the power supply comprises a rechargeable lithium ion polymer battery; recharging of the battery may be by way of the key tip/pins 1103 or the key USB port 1011; charging time is approximately 2 hours for a fully depleted battery; battery capacity is measured and can be viewed each time the key communicates with CyberAudit software; optional email notifications of battery status are available; internal memory supports an audit trail of over 10,000 events; memory is non-volatile; all information stored in the key's memory is retained regardless of battery charge; complete depletion of the battery may require docking the key for clock restart; communication with the key is by way of any compatible CyberLock Communicator (via the key tip/pins 1103) or via the key's USB port 1011; and the key incorporates LED light and beeper operation/status indicators.

The electronic key described herein, in preferred embodiments, operates with electronic lock cylinders (sometimes referred to in the industry as e-cylinders) substantially as described in U.S. Pat. No. 6,474,122, filed Feb. 13, 2001, (i.e. the '122 patent) which is incorporated by reference herein. The '122 patent and its family of patents describes the operation of substantially similar electronic locks and electronic keys, and improvements described herein are each separable aspects which may be separately incorporated (one or more improvement described herein at a time) into particular electronic lock cylinders and/or particular electronic keys.

The keys shown in and described with respect to FIGS. 8A, 8B, 9, 10, and 11 preferably include an improved 8 bit, 64 kbyte, 48 Mhz CPU (or microprocessor) that is newer, faster, lower cost, and enables additional features such as USB 2.0 support and future development of a true file system architecture. The improved CPU preferably supports adding a 13.56 MHz RFID tag to the keys, so that the user only needs the mechatronic key (i.e. an electronic key as described herein) to enter certain (perhaps perimeter) access points with the RFID tag providing contactless access to other premises (or any other functionality inherent in use of such RFID tag). The keys preferably include improved 8 Mbit flash (1 Mbyte) memory, providing capability to manage data from ten or more different databases, storing a greater number of access events, controlling parameters, etc. The memory preferably comprises encrypted access codes, a list of locks the key may access, schedules of authorized dates and times the key may access locks (or particular locks), and a begin-end date range during which the key will operate. Preferably, each time a key 800 touches a CyberLock electronic cylinder lock (such as lock cylinder 100), the key records the lock ID, date, time, and authorization status.

In preferred embodiments, the electronic key 800 comprises dual means for contact-based (i.e. non-wireless) communications. The present inventor determined that contact-based communications improves the security of the access control system comprising contact-based electronic keys and electronic locks, with some higher security applications requiring the use of systems that do not incorporate wireless communications means, such as, for example, IRDA communications for programming/authorizing/downloading electronic keys. In preferred embodiments, the electronic key 800 incorporates dual contact-based communication means via contact pins 1103 for contact-based communication with an electronic cylinder, as described in the '122 patent, as well as a micro-USB connector 1111/micro-USB receptacle 1011 for contact-based communication with a computer or other programming/authorizing/downloading system. Dual communications, in some embodiments, includes communication between an electronic key and an electronic cylinder via the CyberKey Port (i.e. through the key tip pins 1103) and/or via full speed USB 2.0 (i.e. through the USB connector/receptacle 1111, 1011). In preferred embodiments, the electronic key 800 comprises dual connectors, via the CyberKey Tip and micro USB type 'B' receptacle 1011.

The dual connector/dual communications equipped electronic key 800 preferably maintains compatibility with all versions of CyberLock electronic cylinders, CyberKey downloaders (i.e. USB Station, Web Station, Mini-Keyport with Web Authorizer, Flex Mini-Keyport with Flex Hub, Flex WR with Flex Hub, V1 Vault/single key box, V20 Vault/20 key cabinet, etc.), and CyberLock software (i.e. CyberAudit Web, etc.).

Also in preferred embodiments, the rechargeable battery 1109 may be charged via the key tip pins 1103 and/or via the USB connector/receptacle 1111, 1011. In some embodiments, the key 800 may be recharged using a standard mini-USB-to-12v USB car adapter/car charger (for charging the key in a car), or using a standard mini-USB-to-USB cord (for charging the key from a laptop or other computer), or using any compatible device capable of providing power to the key via its USB port.

In existing systems using electronic keys and electronic locks, access schedule/access profile information contained in a particular key is not modified when the key comes into contact with and communicates with a lock. That is, in current systems reading a lock does not modify access schedules. The present inventor discovered a method of using an electronic lock cylinder such as electronic lock 100 (or access point or device such as a CyberPoint electronic monitor) to provide access profile information to a key such that when the key touches the lock, the lock gives the key a new access profile.

As an example, an electrician with a key touches a particular lock cylinder with the key, and if the key is authorized for the lock then the lock provides the key with new access schedule/access profile information. The new access profile may, for instance, provide access to certain electrical boxes for a predetermined period of time, say 8 hours, or between certain hours, such as between 7 am and 6 pm. In this way, the electrician is able to use the key for authorized access to a lock, and the lock then provides the key with a new access profile—i.e. access profile comprising, for example, encrypted access codes, a list of locks the key may access, schedules of authorized dates and times the key may access locks (or particular locks), and a begin-end date range during which the key will operate. The electrician is then limited to access according to the new access profile read into the key.

In this fashion, a sequence of authorized access may be implemented. In the above example, after the electrician's key is effectively reprogrammed with new authorizations by touching the first lock, the electrician's key may be authorized for a particular (second) new set of locks. Touching one of those locks may in turn provide the electrician's key with yet another access profile, for example, providing access to a third set of locks. Thus, the electrician's access to various locks may be sequenced from one group/set to another. Likewise, access may be sequenced in terms of access times, dates, particular locks, combinations of times, dates, locks, etc., or any single parameter or combination of parameters comprising the key's access profile information.

In one embodiment, the access point or lock capable of providing an authorized key with new access profile information might be programmed to do so only for a period of time, for example, after initial access by an authorized key. Or the lock may be programmed to provide a key with a new access profile on a predetermined date, within a predetermined window of time, and/or after a predetermined number of accesses or attempted accesses with the key. For example, a key may be authorized to access a particular lock between 7:30 am and 8:00 am, the lock programmed to provide the key with a new access profile to effectively deactivate the key following any attempted access outside of the 7:30 am to 8:00 am time window.

In preferred embodiments, an electronic lock cylinder (or any CyberLock electronic cylinder) may be configured/programmed so as to change the personality—i.e. access profile—of an authorized key. The method preferably comprises: a key with a first access profile touching a lock; the lock providing the key with a new (second) access profile if the key is authorized by the first access profile to access the lock; and if the second access profile is provided to the key, the key is subsequently limited to its new (second) access profile for subsequent use thereafter. In this way, the lock modifies the authorizations or personality of the key.

In one embodiment, programming instructions resident in a key are modified so that the key is susceptible to receiving a new access profile from a lock, and programming instructions resident in the lock are modified so that when an authorized key is presented having suitably modified programming to receive a new access profile, the lock provides the new access profile to the key.

The present inventor further discovered that an electronic cylinder such as lock cylinder 100 (or any CyberLock cylinder) may be programmed to turn an electronic key such as electronic key 800 (or any CyberKey smart key) into a master key (or CyberLock Grand Master key) by touching the key to the specially programmed cylinder. The specially programmed cylinder may be used instead of having to hold onto a Grand Master key or another key with master key-like authorizations, for use in emergencies such as when authorized keys are lost. Instead of locking away a Grand Master or other similarly configured key, a specially programmed cylinder, for example, a specially programmed CyberPoint non-locking type cylinder may be used to convert a presented key into a master key. The specially programmed cylinder may comprise an electronic cylinder, as described above, capable of providing a key with a new access profile, in this case, an access profile enabling the key to behave as a master key.

In one embodiment, the programming code in the key is changed so that the key can have multiple states, switchable when the key comes into contact with a pre-programmed, specially programmed cylinder. The key may comprise a table or structure that would include the multiple states for the key. The structure in the key preferably accommodates and manages both multiple lock lists and multiple indices. The indices may represent particular predetermined states of the key, predetermined lock lists, predetermined or programmably assignable access profiles, or other features, characteristics, and/or attributes for the key.

In a preferred embodiment, a virgin key (i.e. a key not yet programmed, or an unprogrammed key, or blank key, or key put into an unprogrammed state) touching a control CyberPoint (non-locking) electronic cylinder would cause the key to become a Grand Master (or simply, master) key after receiving from the cylinder the appropriate programming instructions; and a Grand Master (or master) key touching a virgin (unprogrammed) lock would program it so as to be accessible to the (now, master) key.

In one embodiment, existing infrared capable CyberKey smart keys may be upgraded so as to provide the above described behavior (i.e. capability of becoming a master key) by using code space currently occupied by IRDA (infrared) code to instead provide the capability of allowing a lock (or a cylinder such as cylinder 100 or a non-locking cylinder such as the CyberPoint cylinder) adapted with programming instructions to program a key.

The terms and expressions which have been employed in the forgoing specification are used therein as terms of description and not of limitation, and there is no intention in the use of such terms and expressions of excluding equivalence of the features shown and described or portions thereof, it being recognized that the scope of the invention is defined and limited only by the claims which follow.

I claim:

1. An apparatus comprising:

(a) a lock pin; and (b) a lock pin blocking member movable longitudinally in a direction orthogonal to a direction of movement of said lock pin, said lock pin resiliently urged to a first position free of contact with said blocking member, said blocking member resiliently urged to a lock pin blocking longitudinal position blocking movement of said lock pin from said first position to a second position where a portion of said lock pin projects into a space occupied by a portion of said blocking member when said blocking member is in said lock pin blocking longitudinal position, said blocking member selectively moveable to a lock pin releasing position when said lock pin is in said first position, said lock pin releasing position permitting selective movement of said lock pin to said second position; said blocking member including an increased height region along a longitudinal portion of said blocking member and a decreased height region formed along an adjoining longitudinal portion, said increased height region impeding longitudinal movement of said blocking member from said lock pin blocking longitudinal position when said lock pin is urged into contact with said decreased height region of said blocking member.

2. An apparatus comprising:

(a) a shell;

(b) a cylinder including a nose portion engageable with a portion of a key, said cylinder arranged for rotation in said shell;

(c) a lock pin slidably arranged in said cylinder for movement transverse to a rotational axis of said cylinder, said lock pin resiliently urged away from said rotational axis toward a locking position interfering with rotation of said cylinder in said shell; and (d) a plunger axially movable in said cylinder and resiliently urged to a first position blocking movement of said lock pin to an unlocking position but selectively moveable toward said nose portion of said cylinder to a non-blocking position enabling selective rotation of said cylinder and movement of said lock pin to said unlocking position, said plunger including a surface arranged to interfere with movement of said plunger to said non-blocking position when said surface is contacted by said lock pin.

3. The apparatus of claim 2 wherein said surface is arranged substantially parallel to a direction of movement of said lock pin and transverse to a direction of movement of said plunger.

4. The apparatus of claim 2 wherein said surface connects a first surface of said plunger and a second surface of said plunger, said first surface spaced farther from a longitudinal axis of said plunger than said second surface.

5. The apparatus of claim 2 wherein interference with movement of said plunger is relievable by movement of said lock pin toward said locking position.

6. An apparatus comprising:

(a) a shell;

(b) a cylinder including a nose portion engageable with a portion of a key, said cylinder arranged for rotation in said shell;

(c) a lock pin slidably arranged in said cylinder for movement transverse to a rotational axis of said cylinder and resiliently urged away from said rotational axis toward a locking position interfering with rotation of said cylinder in said shell, rotation of said cylinder urging said lock pin toward said rotational axis; and (d) a plunger movable axially in said cylinder in a direction transverse to said movement of said lock pin, said plunger resiliently urged away from said nose portion of cylinder toward a blocking position interfering with movement of said lock pin toward said rotational axis of said cylinder and selectively movable to a non-blocking position not interfering with movement of said lock pin toward said rotational axis of said cylinder, said plunger including a surface arranged to interfere with movement of said plunger to said non-blocking position when said lock pin is urged into contact with said plunger by rotation of said cylinder.

7. The apparatus of claim 6 wherein said surface is arranged substantially parallel to a direction of movement of said lock pin and transverse to a direction of movement of said plunger.

8. The apparatus of claim 6 wherein said surface connects a first surface of said plunger and a second surface of said plunger, said first surface spaced farther from a longitudinal axis of said plunger than said second surface.

9. The apparatus of claim 6 wherein interference with movement of said plunger is relievable by counter rotation of said cylinder enabling movement of said lock pin toward said locking position.

* * * * *

UNITED STATES PATENT AND TRADEMARK OFFICE

CERTIFICATE OF CORRECTION

PATENT NO. : 8,720,238 B1
APPLICATION NO. : 13/728417
DATED : May 13, 2014
INVENTOR(S) : Paul R. Davis It is certified that error appears in the above-identified patent and that said Letters Patent is hereby corrected as shown below:

In the Specification

Col. 3, Line 46

Change "providing a key Lip" to read --providing a key tip--.

Signed and Sealed this
Eighteenth Day of November, 2014

Michelle K. Lee

Michelle K. Lee
*Deputy Director of the United States Patent and Trademark Office*